United States Patent [19]

Osburg

[11] 4,210,045

[45] Jul. 1, 1980

[54] SLITTER HAVING ADJUSTABLE CIRCULAR KNIVES

[75] Inventor: Dieter Osburg, Neuss-Weckhoven, Fed. Rep. of Germany

[73] Assignee: Jagenberg Werke Aktiengesellschaft, Dusseldorf, Fed. Rep. of Germany

[21] Appl. No.: 934,301

[22] Filed: Aug. 17, 1978

[30] Foreign Application Priority Data

Sep. 15, 1977 [DE] Fed. Rep. of Germany ..... 2741559

[51] Int. Cl.[2] ..... B26D 1/24

[52] U.S. Cl. ..... 83/497

[58] Field of Search ..... 83/496, 497

[56] References Cited

U.S. PATENT DOCUMENTS

| | | | |
|---|---|---|---|
| 559,179 | 4/1896 | Koegel | 83/497 |
| 668,945 | 2/1901 | Allen | 83/497 X |
| 3,682,032 | 8/1972 | Pfeiffer | 83/496 |

*Primary Examiner*—J. M. Meister

*Attorney, Agent, or Firm*—Sprung, Felfe, Horn, Lynch & Kramer

[57] ABSTRACT

A slitter for web material comprises at least one pair of rotatable circular knives each comprising a lower cup knife and an upper disc knife which plunges into the web material during use. The upper disc knife is disposed with its axis perpendicular to the line of movement of the web of goods and the lower cup knife is disposed with its axis at a selected angle to the line of movement of the web of goods.

1 Claim, 4 Drawing Figures

SLITTER HAVING ADJUSTABLE CIRCULAR KNIVES

BACKGROUND

The invention concerns a slitter for material in web form, especially webs of paper and cardstock, having a rotating pair of circular knives consisting of a lower cup knife and an upper disk knife which plunges into the web material when cutting, the one circular knife being disposed with its axis perpendicular to the line of movement of the web and the other circular knife being disposed with its axis at an angle to the line of movement of the web.

In a known slitter of this kind, the lower, cup knife is the one whose axis is perpendicular to the line of movement of the web, while the upper disk knife is disposed at a slight angle thereto. In cutting with such a slitter it has been found disadvantageous that due to the angular disposition of the upper knife the cut edge of the material is displaced laterally from its line for movement by the back of the upper knife plunging into the web of goods. This places a stress on the cut edge and results in a greater production of cutting dust.

THE INVENTION

The object of the invention is to create a slitter for material in web form, in which the cut material is not displaced from its line of movement.

This object is achieved in accordance with the invention in that the upper circular knife is the one whose axis is disposed perpendicular to the direction of movement of the web.

With this arrangement of the pair of circular knives, the cut web of material is not displaced from its line of movement, since the cutting edge of the knife plunging into the material is parallel with the line of movement of the web. Displacement is not produced by the lower, cup-shaped knife, since it does not plunge into the material. By this simple measure, which involves no additional cost, a reduction of cutting dust is achieved.

Such slitters can, as it is known, be disposed side by side in a row, the disk knives, which are displaceably mounted on a rail, revolving freely, and the lower, cup-shaped knives, which are also displaceably mounted on a rail, being driven. In a slitter of this kind, however, a difficulty arises with regard to the driving of the cup knives. As long as the cup knives are driven with their axes perpendicular to the line of movement of the web there is no difficulty involved in driving them, and they can be driven, for example, by a common shaft. If they are set at an angle this is no longer possible. However, a suitable drive for knives set at an angle is one in which each cup knife is pivoted on a support carrying a driven belt pulley by which the cup knife is driven through a pivoting belt drive. Such a drive does not require any great expense in its construction, either. The belt pulleys mounted on the support can be driven by a common shaft the same as before.

BRIEF DESCRIPTION OF THE DRAWINGS

The invention will now be described with the aid of the drawings, wherein.

DETAILED DESCRIPTION OF THE INVENTION

Figure 1:
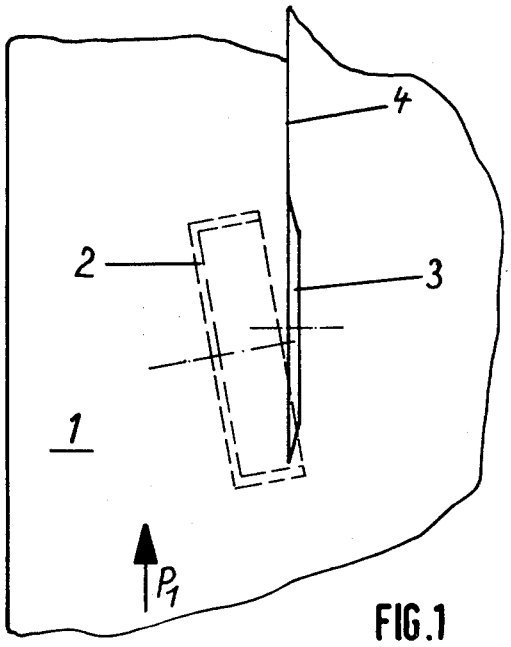
FIG. 1 is a top view of a pair of circular knives engaged in slitting web material.
Figure 2:
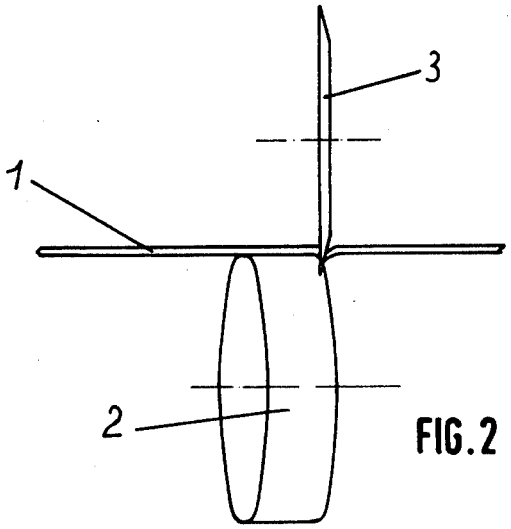
FIG. 2 is a side view of the pair of circular knives of FIG. 1.

Referring to FIGS. 1 and 2, a web of material moves in the direction of the arrow $P_1$. During this movement it is cut along a line 4 by a pair of circular knives consisting of a cup knife 2 and a disk knife 3. The cup knife 2 is disposed underneath the web of goods and its axis is at a slight angle to the line of movement $P_1$ of the web of material. The disk knife 3 disposed above the web 1 is disposed with its axis perpendicular to the line of movement $P_1$ of the web. Accordingly, the cutting edges of the two circular knives 2 and 3 form a shear angle with one another. In cutting, the disk knife 3 plunges into the web of goods 1 pushing the web downwardly after the cut. No lateral displacement of the web of goods takes place. For this reason, the cut is made gently, and comparatively less cutting dust is created than in the case of an angular position of the disk knife.

Figure 3:
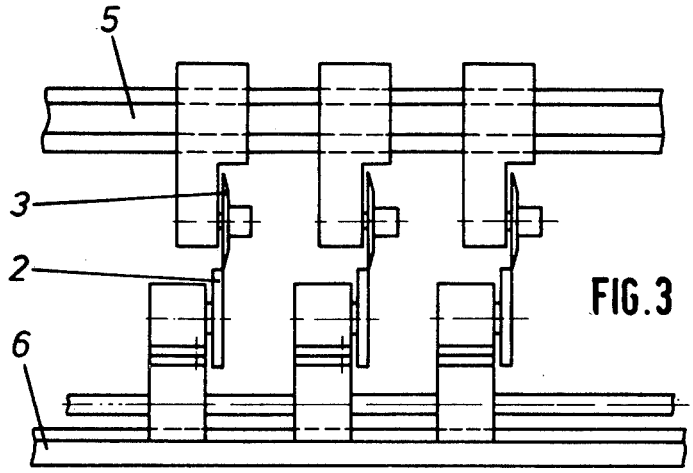
FIG. 3 is a diagrammatic front view of a plurality of pairs of circular knives disposed side by side on rails.
Figure 4:
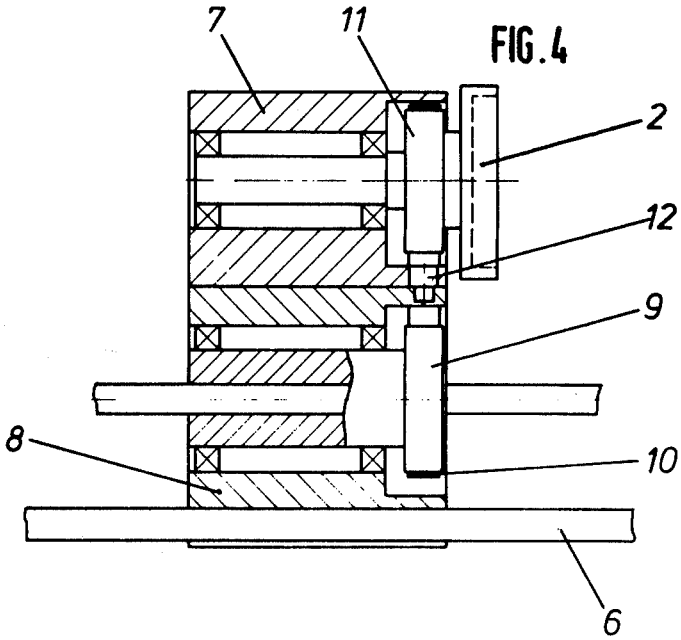
FIG. 4 is an axial cross section of a cup knife disposed on a support.

As it can be seen in FIG. 3, the upper disk knives 3 are displaceably disposed on a rail 5 and the lower knives, which are cup knives 2, are displaceably disposed on a rail 6, and can be locked in the desired position by clamping means which are not shown. The cup knife 2 is journaled in a journal box 7 which is carried by a support 8 which in turn is mounted on the rail 6. The support 8 bears a driven belt pulley 9 which through a belt 10 drives a belt pulley 11 of the cup knife 2. The journal box 7 can be pivoted about a pin 12 disposed in the center between the belt pulleys for the purpose of adjusting the desired angular setting of the cup knife 2. The journal box 7 can be locked in the desired angular position by means of bolts which are not shown.

With the slitter of the invention, therefore, an angular setting of the cup knife can be achieved while the disk knife is set straight, while at the same time the cup knife drive remains relatively simple.

It will be appreciated that the instant specification and claims are set forth by way of illustration and not limitation, and that various changes and modifications may be made thereto without departing from the spirit and scope of the present invention.

What is claimed is:

1. Slitter for web material such as paper and cardstock webs and the like, comprising a plurality of pairs of rotatable circular knives disposed side by side each comprising a lower cup knife and an upper disk knife which plunges into the web material during use, means mounting each upper disk knife on a rail with its axis perpendicular to the line of movement of the web of goods to run freely and for adjustable movement perpendicular to the line of movement of the web, means mounting each lower cup knife on a rail with its axis at a selected angle to the line of movement of the web of goods for adjustable movement perpendicular to the line of movement of the web and for pivotal movement on a support to obtain the selected angle and means for driving each lower knife comprising a belt pulley mounted in the support and a pivotable belt drive mounted in the support.

* * * * *